US011535996B2

(12) United States Patent
Markopoulos et al.

(10) Patent No.: US 11,535,996 B2
(45) Date of Patent: Dec. 27, 2022

(54) FLOOD BARRIERS

(71) Applicant: SYSTEM STORMSEAL PTY LTD, Rockdale (AU)

(72) Inventors: Andrew Markopoulos, Rockdale (AU); Matthew Lennox, Rockdale (AU); Justin Gallagher, Rockdale (AU)

( * ) Notice: Subject to any disclaimer, the term of this patent is extended or adjusted under 35 U.S.C. 154(b) by 0 days.

(21) Appl. No.: 16/603,250

(22) PCT Filed: Apr. 9, 2018

(86) PCT No.: PCT/AU2018/050324

§ 371 (c)(1),
(2) Date: Oct. 7, 2019

(87) PCT Pub. No.: WO2018/184077

PCT Pub. Date: Oct. 11, 2018

(65) Prior Publication Data

US 2021/0079615 A1 Mar. 18, 2021

(30) Foreign Application Priority Data

Apr. 7, 2017 (AU) ..... 2017202329

(51) Int. Cl.
*E02B 3/10* (2006.01)
*E02B 3/12* (2006.01)

(52) U.S. Cl.
CPC ..... *E02B 3/108* (2013.01); *E02B 3/122* (2013.01)

(58) Field of Classification Search
CPC ... E02B 3/04; E02B 3/10; E02B 3/108; E02B 3/122
See application file for complete search history.

(56) References Cited

U.S. PATENT DOCUMENTS

| | | | | |
|---|---|---|---|---|
| 5,624,511 | A * | 4/1997 | Lippman | B29C 65/7835 156/157 |
| 6,692,188 | B1 | 2/2004 | Walker et al. | |
| 7,712,998 | B2 | 5/2010 | Salemie | |
| 9,528,236 | B2 * | 12/2016 | Vickers | E02B 3/10 |
| 9,562,335 | B1 | 2/2017 | Arrington | |
| 2007/0243021 | A1 | 10/2007 | Tyler | |
| 2012/0186722 | A1 * | 7/2012 | Lennox | E04G 21/28 156/85 |
| 2012/0263897 | A1 * | 10/2012 | Williams, IV | F16B 4/008 428/35.1 |
| 2013/0071188 | A1 | 3/2013 | Taylor | |
| 2016/0319504 | A1 | 11/2016 | Vickers | |

FOREIGN PATENT DOCUMENTS

| | | |
|---|---|---|
| CA | 2214365 A1 | 4/1999 |
| FR | 2730263 A1 | 8/1996 |

OTHER PUBLICATIONS

European Patent Office Search Report; dated Nov. 20, 2020.
ISR; Australian Patent Office; dated Jul. 11, 2018.

* cited by examiner

*Primary Examiner* — Sean D Andrish
(74) *Attorney, Agent, or Firm* — Patshegen IP; Moshe Pinchas

(57) ABSTRACT

A flood mitigation barrier comprising a line of central structures wrapped in a flexible heat shrinkable polymer material. The polymer material is configured such that when heat is applied to the material, shrinks to conform around the central structures.

7 Claims, 7 Drawing Sheets

FLOOD BARRIERS

TECHNICAL FIELD

The present invention relates to flood barriers and, more particularly although not exclusively, to temporary flood barriers which may be erected in emergency flood situations.

BACKGROUND

Flood barriers for the protection of lives and property along water courses have been known since ancient times, sometime taking the form of permanent earthwork embankments, or more permanent stone wall constructions.

In modern times, temporary flood barriers have generally taken the form of assemblies of sandbags, often filled on or near the site of the expected flooding. Other forms of barriers have been proposed such as that disclosed in U.S. Pat. No. 6,334,736B1 or U.S. Pat. No. 5,645,373A, each of which rely on flexible or non-rigid material to form a fluid fillable or inflatable barrier. Barrier systems such as those of the cited prior art, rely on made-for-purpose structural elements, expensive in manufacture and storage between deployments.

Sandbags, while effective up to a point, become saturated and are liable to increasing seepage. As well they may become breached by fast flowing water dislodging a number of bags leading to sudden catastrophic failure of the barrier.

Other known flood barriers are in the form of fabricated sections comprising a framework usually triangular in cross section with metal cladding on the sloping side facing the expected flood water. The cladding is then covered with tarpaulin or other water proof material. Disadvantages of this arrangement include the expense of the tarpaulin material and the need to secure the material to the framework, for example with loops of heavy chain draped over the tarpaulin.

It is an object of the present invention to address or at least ameliorate some of the above disadvantages.

Notes

The term "comprising" (and grammatical variations thereof) is used in this specification in the inclusive sense of "having" or "including", and not in the exclusive sense of "consisting only of".

The above discussion of the prior art in the Background of the invention, is not an admission that any information discussed therein is citable prior art or part of the common general knowledge of persons skilled in the art in any country.

SUMMARY OF INVENTION

Accordingly, in a broad form of the invention, there is provided a flood mitigation barrier; the barrier comprising a line of central structures wrapped in a flexible heat shrinkable polymer material.

Preferably, the line of central structures comprises an elongate assembly of stacked sandbags.

Preferably, the line of central structures comprises a line of road barriers placed end to end.

Preferably, the line of central structures comprises sections of metal frames of triangular cross section placed end to end.

Preferably, a layer or dry cement or dry cement/sand mix is laid along an intended path of the flood mitigation barrier.

Preferably, sections of sheets of the flexible heat shrinkable polymer material are positioned with overlaps between adjacent sections of sheet along the intended path of the flood mitigation barrier; the sections of sheets positioned over the layer of dry cement or dry cement/sand mix; edges of the overlaps heat welded together to form a continuous strip along the intended path.

Preferably, the central structures are positioned centrally along the continuous strip of the flexible heat shrinkable polymer material.

Preferably, opposing outer edges of the continuous strip of the flexible heat shrinkable polymer material are drawn up and over the central structures; overlapping edges of the outer edges heat welded together to enwrap the central structures.

Preferably, heat is applied to the flexible heat shrinkable polymer material enwrapping the central structures to conform the heat shrinkable material to the central structures.

Preferably, moisture applied to the layer of dry cement or dry cement/sand mix forms a seal below the flood mitigation barrier.

Preferably, an impervious apron is provided extending from a flood facing toe of the barrier to form an impervious strip over the ground surface.

Preferably, proximate edges of the impervious strip are heat welded to the heat shrinkable material enveloping the barrier.

In another broad form of the invention, there is provided a method of forming a flood mitigation barrier; the method including the steps of:

- preparing an intended path of the flood mitigation barrier with a layer of settable material,
- sequentially positioning sections of sheets of a flexible heat shrinkable polymer material along the intended path,
- heat welding overlap portions of adjacent sections of sheets to form a continuous strip of the flexible heat shrinkable polymer material along the intended path,
- positioning a line of structures centrally along the continuous strip,
- drawing opposing outer edges of the continuous strip up and over the structures,
- heat welding overlap portions of the outer edges,
- applying heat to the flexible heat shrinkable polymer material to conform the material to the structures.

Preferably, the line of structures comprises an elongate assembly of stacked sandbags.

Preferably, the line of structures comprises a line of road barriers placed end to end.

Preferably, the line of structures comprises sections of metal frames of triangular cross section placed end to end.

Preferably, formation of the continuous strip of the flexible heat shrinkable polymer material includes the steps of:

- positioning an elongate supporting element on a ground surface.
- extending a rope or cable attached at an end of the supporting element along an intended position of an overlap of a first two adjoining sections of the flexible heat shrinkable polymer material,
- positioning the two adjoining lengths of the flexible heat shrinkable polymer material with a predetermined overlap over the supporting element and the rope or cable,
- positioning a guide rail assembly over a first overlap portion of the two adjoining lengths of the flexible heat shrinkable polymer material and coincident with the supporting element, moving a heat gun provided with a heat directing shroud along the guide rail assembly to fuse the first overlap portion of the two lengths of flexible heat shrinkable polymer material together.

Preferably, the method further includes the steps of:

removing the guide rail assembly and the elongate supporting element from the first two adjoining sections of the flexible heat shrinkable polymer material and applying the steps set out above to a next overlap of the continuous strip of the flexible heat shrinkable polymer material.

Preferably, the method includes the further steps of providing an apron of impervious material extending from a flood facing toe of the barrier to form an impervious strip of material along the flood side of the barrier.

Preferably, proximate edges of the strip of impervious material are heat welded to the heat shrinkable material covering the barrier.

In another broad form of the invention, there is provided a method of forming an elongate assembly of sandbags into an impermeable flood mitigation barrier; the method including the steps of:

preparing an intended path of the flood mitigation barrier with a continuous strip of flexible heat shrinkable polymer material; the strip formed by heat welding together overlap portions of sections of sheet of the flexible heat shrinkable polymer material, forming the elongate assembly of sandbags along a central portion of the continuous strip of the flexible heat shrinkable polymer material, drawing opposing outer edges of the continuous strip of the flexible heat shrinkable polymer material up and over the assembly of sandbags, trimming off excess material to form an overlap and heat welding the overlap, applying heat to the flexible heat shrinkable polymer material to conform the material closely to the sandbags.

Preferably, the method includes the further steps of providing an apron of impervious material extending from a flood facing toe of the barrier to form an impervious strip of material along the flood side of the barrier.

Preferably, proximate edges of the strip of impervious material are heat welded to the heat shrinkable material covering the barrier.

In another broad form of the invention, there is provided a method of forming a line of road barriers into an impermeable flood mitigation barrier; the method including the steps of:

preparing an intended path of the flood mitigation barrier with a continuous strip of flexible heat shrinkable polymer material; the strip formed by heat welding together overlap portions of sections of sheet of the flexible heat shrinkable polymer material, positioning the line of road barriers along a central portion of the continuous strip of the flexible heat shrinkable polymer material, drawing opposing outer edges of the continuous strip of the flexible heat shrinkable polymer material up and over the road barriers, trimming off excess material to form an overlap and heat welding the overlap, applying heat to the flexible heat shrinkable polymer material to conform the material closely to the road barriers.

In another broad form of the invention, there is provided a method of forming a line of structures comprising sections of metal frames of triangular cross section into an impermeable flood mitigation barrier; the method including the steps of:

preparing an intended path of the flood mitigation barrier with a continuous strip of flexible heat shrinkable polymer material; the strip formed by heat welding together overlap portions of sections of sheet of the flexible heat shrinkable polymer material, positioning the line of metal frames along a central portion of the continuous strip of the flexible heat shrinkable polymer material, drawing opposing outer edges of the continuous strip of the flexible heat shrinkable polymer material up and over the metal frames, trimming off excess material to form an overlap and heat welding the overlap, applying heat to the flexible heat shrinkable polymer material to conform the material closely to the road barriers.

Preferably, a seal is provided under the flood mitigation barrier by water acting on a layer of dry cement or dry cement/sand mixed placed under the flood mitigation barrier.

BRIEF DESCRIPTION OF DRAWINGS

Embodiments of the present invention will now be described with reference to the accompanying drawings wherein.

DESCRIPTION OF EMBODIMENTS

First Preferred Embodiment

Figure 1:
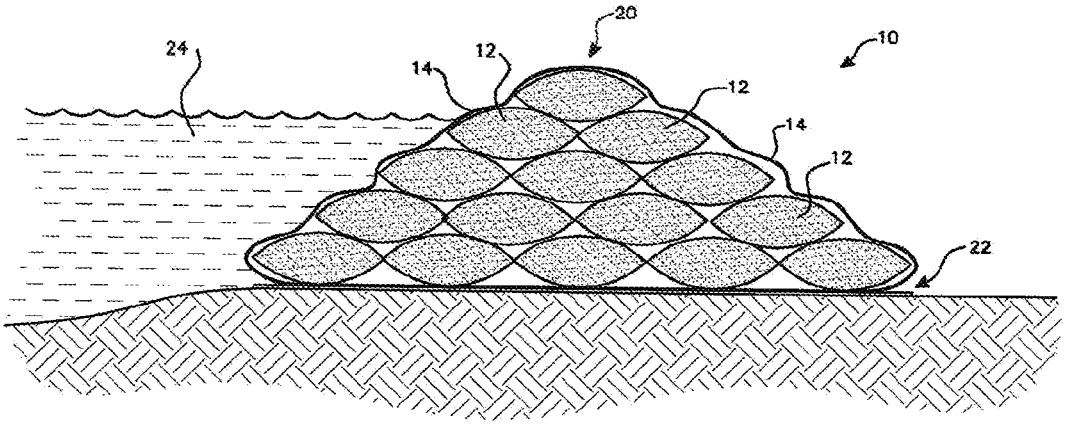
FIG. 1 is a sectioned end view of a flood barrier according to a first preferred embodiment of the invention.
Figure 3:
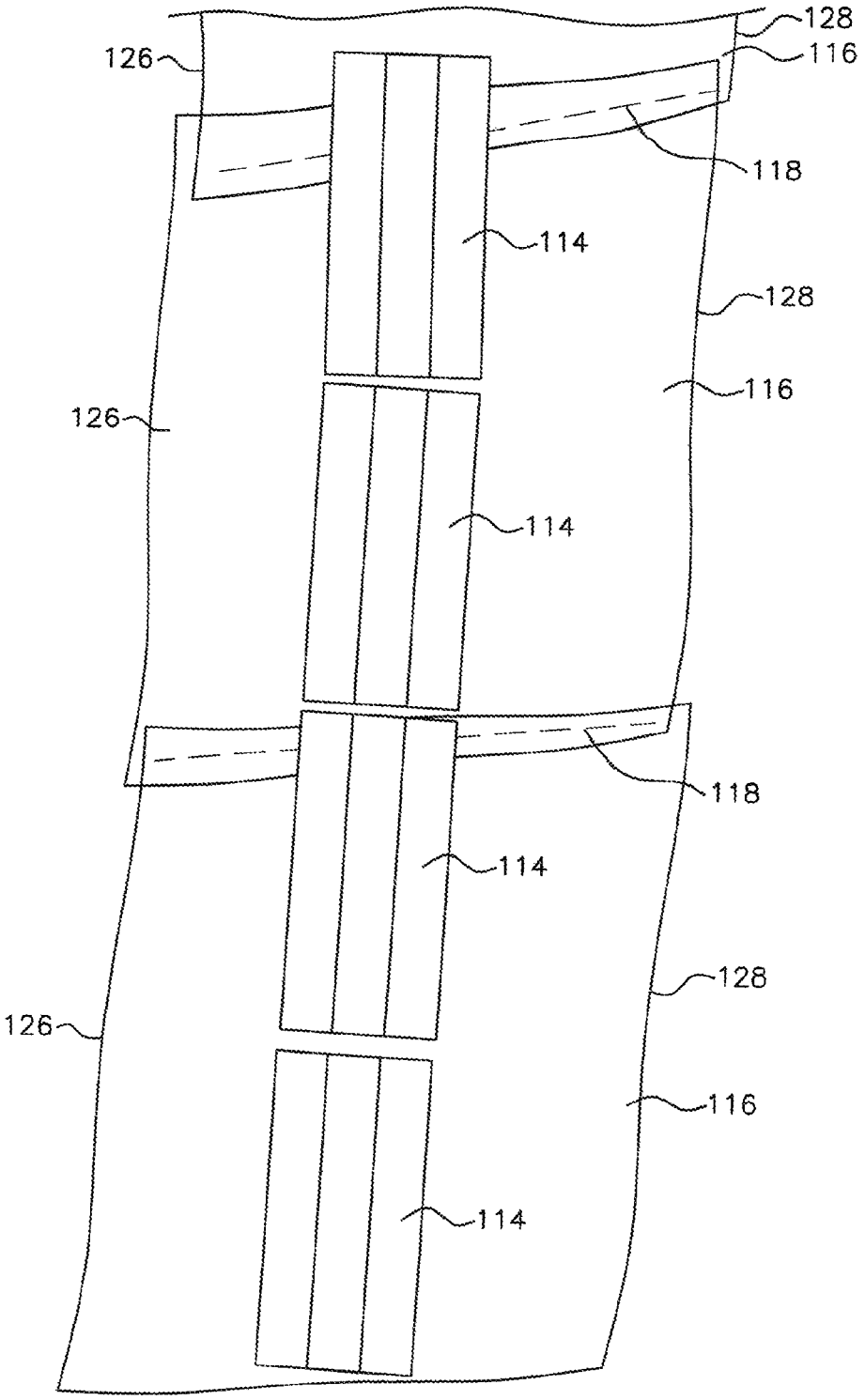
FIG. 3 is a plan view of the flood barrier of FIG. 2 during construction.

With reference to FIGS. 1 and 3, in this first embodiment of the invention, a flood barrier 10 is formed as an elongate assembly of stacked sandbags 12 as is common practice. According to the invention however, this assembly of sandbags 12 is transformed into an impervious barrier by the application of a flexible heat shrinkable polymer material 14 wrapped about the assembly.

To construct a flood barrier 10 according to this first preferred embodiment, a number of sheets 16 of the heat shrinkable polymer material 14 are laid out sequentially along the path of the proposed flood barrier (as shown in FIG. 3) and assembled together by welding 18 as described below and as previously disclosed in the present applicant's earlier patent application AU2016200398.

If the height of the intended barrier is low enough to enable wrapping of the stacked sandbags within the width, preferably 5 m, of a roll of sheeting, the sheeting may be laid out in long strips along the path of the barrier. For narrower material or for higher barriers, or for curving sections of the barrier, required lengths of the material are cut from a supply roll (not shown), laid in position transverse to the path of the barrier and welded together before constructing the assembly of sandbags in the centre of the laid out sheeting. The outer edges of the sheeting are then drawn up over the sandbags, any excess material trimmed off to leave an overlap and the overlap heat welded along the top 20 of the bag assembly.

After wrapping, heat guns are used to shrink the material 14 into closely conforming to the assembly of sandbags 12. By this means the barrier 10 is rendered impervious and the relatively smooth surface of the enveloping polymer sheeting prevents fast moving eddies of flood water gaining a purchase on the sandbags, preventing their dislodgment out of the assembly.

Preferably, a layer 22 of dry cement or dry cement/sand mix is spread along the path of the intended barrier. When subjected to moisture from flood water 24, or by the application of water from some other source, this layer 22 provides a seal under the wrapped sandbags.

In a variation of the above, a flood barrier may be constructed in similar fashion to that shown in FIG. 1 and described above, but in this instance, instead of enveloping an embankment of sand bags, the heat shrinkable material is arranged to envelop a mound of sand.

Second Preferred Embodiment

Figure 2:
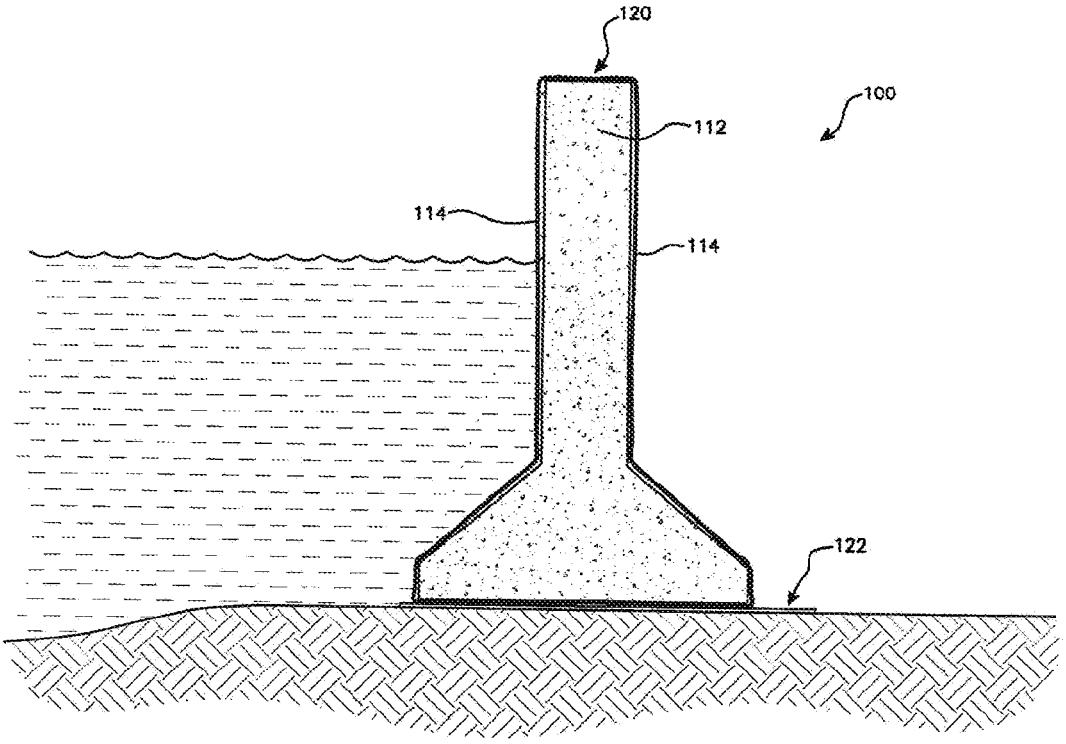
FIG. 2 is a sectioned end view of a flood barrier according to a second preferred embodiment of the invention.

In this second preferred embodiment, with reference now to FIGS. 2 and 3, a flood barrier 100 according to the invention is formed of standard road barriers 112 but again wrapped in flexible heat shrinkable polymer material 114.

These road barriers 112, well known in the art, may be of solid concrete construction or hollow, rotation-moulded plastic, fillable with water to provide stabilising mass.

While it is known to use concrete road barriers 112 of the type shown in FIG. 2 as permanent flood levees, the barriers must be cemented together at their abutting ends and so are only useful where a permanent levee bank is required.

In the present invention, the wrapping of either type of road barrier, allows them to be rapidly deployed as temporary flood barriers.

As for the first preferred embodiment described above, the path of the intended barrier 100 is again prepared, firstly preferably by applying a layer 122 of dry cement or dry cement/sand mix along the path, before laying out sections of flexible heat shrinkable material 116 welded 118 to form a continuous strip along the path. The barriers 112 are then positioning along the centre of the sheets of the flexible heat shrinkable material 116.

As for the sandbag embodiment above, the opposing outer edges 126, 128 of the sheeting are drawn up to meet at the tops of the barriers and welded 120 together. Heat is then applied to closely conform the sheeting to the sides of the barrier to provide a continuous impervious flood barrier which can easily be disassembled once the flood situation is past.

In each of the above described embodiments, the barrier of the invention comprises a central mass wrapped in flexible heat shrinkable material to form a continuous impervious flood mitigation barrier.

Third Preferred Embodiment

Figure 3A:
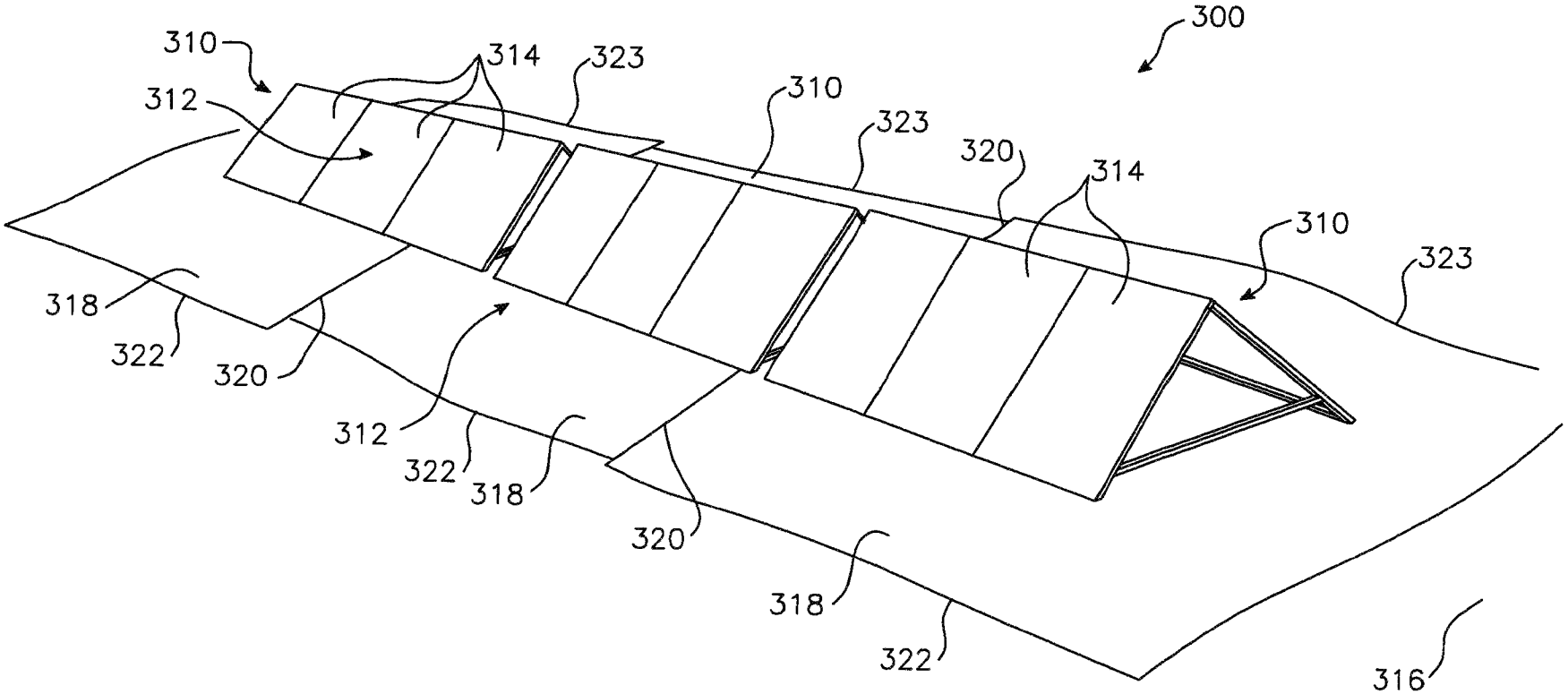
FIG. 3A is a perspective view of a further embodiment of a flood barrier underconstruction.
Figure 4:
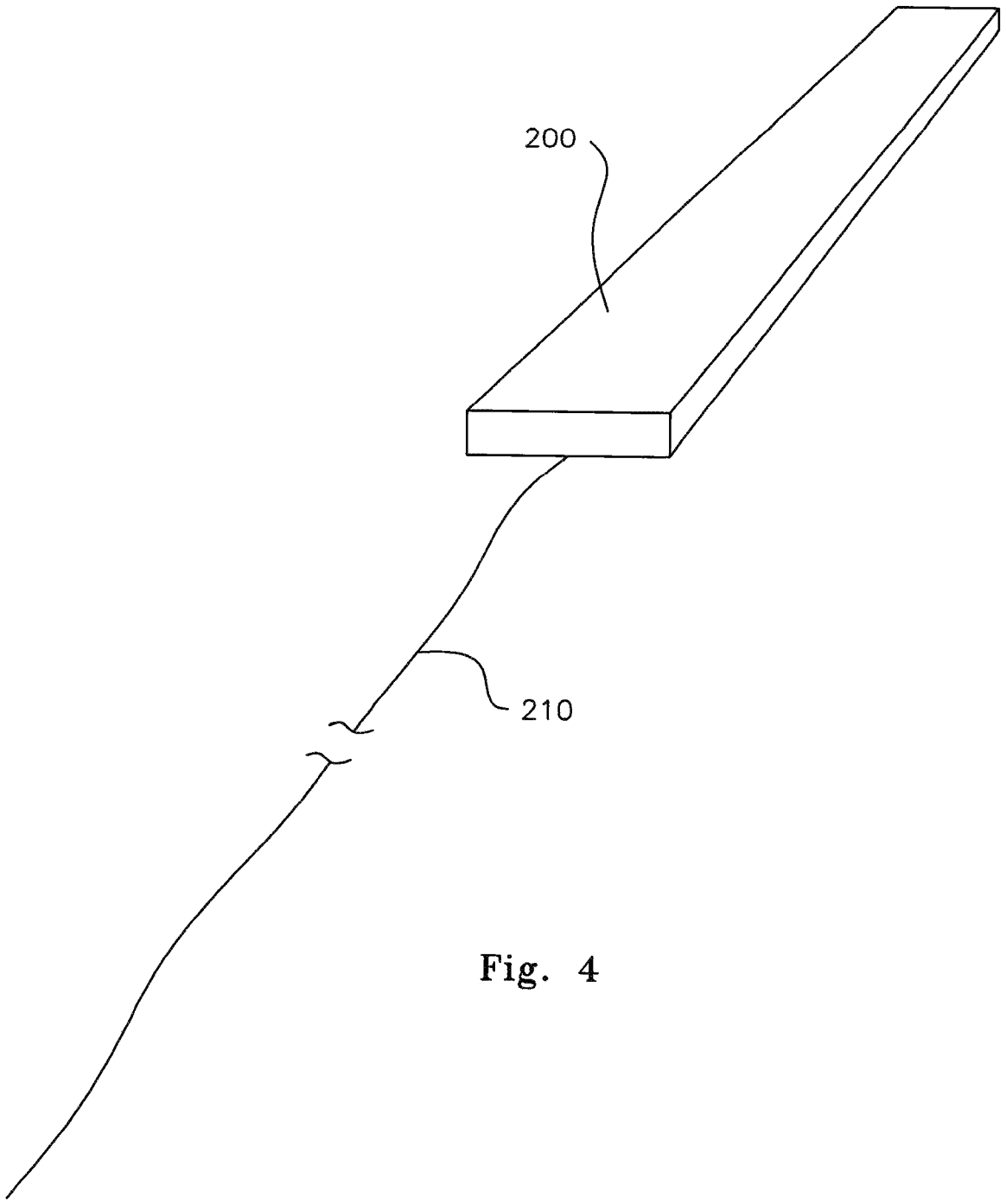
FIGS. 4 and 5 are views of stages of a preferred method of preparing a strip of flexible heat shrinkable polymer material for use in the embodiments of FIGS. 1 and 3

In this preferred embodiment, with reference now to FIG. 3A, a barrier 300 is formed using sections of fabricated, triangular in cross section, metal frame structures 310 which are cladded on one sloping side 312 with metal or other lightweight sheeting 314. It is known to use these types of structures in conjunction with waterproofing sheets of tarpaulin, secured over the cladding.

In this preferred embodiment however, the cladded frame structures 310 are used to form the flood barrier 300 in a similar manner to that described for the Second Preferred Embodiment above with the structures 310 taking the place of the road barriers.

Thus, in this embodiment, the process of erecting the flood barrier 300 according to the invention, includes the initial laying of dry cement or a dry sand/cement mix 316 overlaid with overlapping sheets 318 of heat shrinkable polymer material along the path of the intended flood barrier. The sheets 318 are welded together at their overlaps 320 as explained below, and the framed and cladded structures 310 placed centrally end to end along the assembly of sheets.

The opposing outer edges 322,323 of the sheets 318 are then drawn up and over the top of the structures 310 so as to overlap near the top, and the overlaps welded together. Heat is then applied to the sheets generally to cause them to shrink tightly around the structures.

Sheet Welding

As overlapping sections of the flexible heat shrinkable sheeting are positioned along the path of the intended flood barrier, prior to welding, it is preferable to hold the edge of the uppermost sheet of the overlap in place by adhesive tape to prevent problems in windy conditions.

With reference now to FIGS. 4 to 7, in the present invention, an elongate support element 200 is laid at a convenient location on the ground surface on which the strip of sheets of the flexible heat shrinkable material is to be assembled. The support element 200 may comprise a length of timber or other, substantially heat resistant material, preferably 200 mm wide and somewhat longer than the length of weld in a weld sequence. The support element is provided with an attached rope or cable 210 of sufficient length to extend the length of the lengths of heat shrinkable material to be joined together. This rope or cable 210 is stretched out in line with the support element 200 and along the intended join between two lengths of the material.

Figure 5:
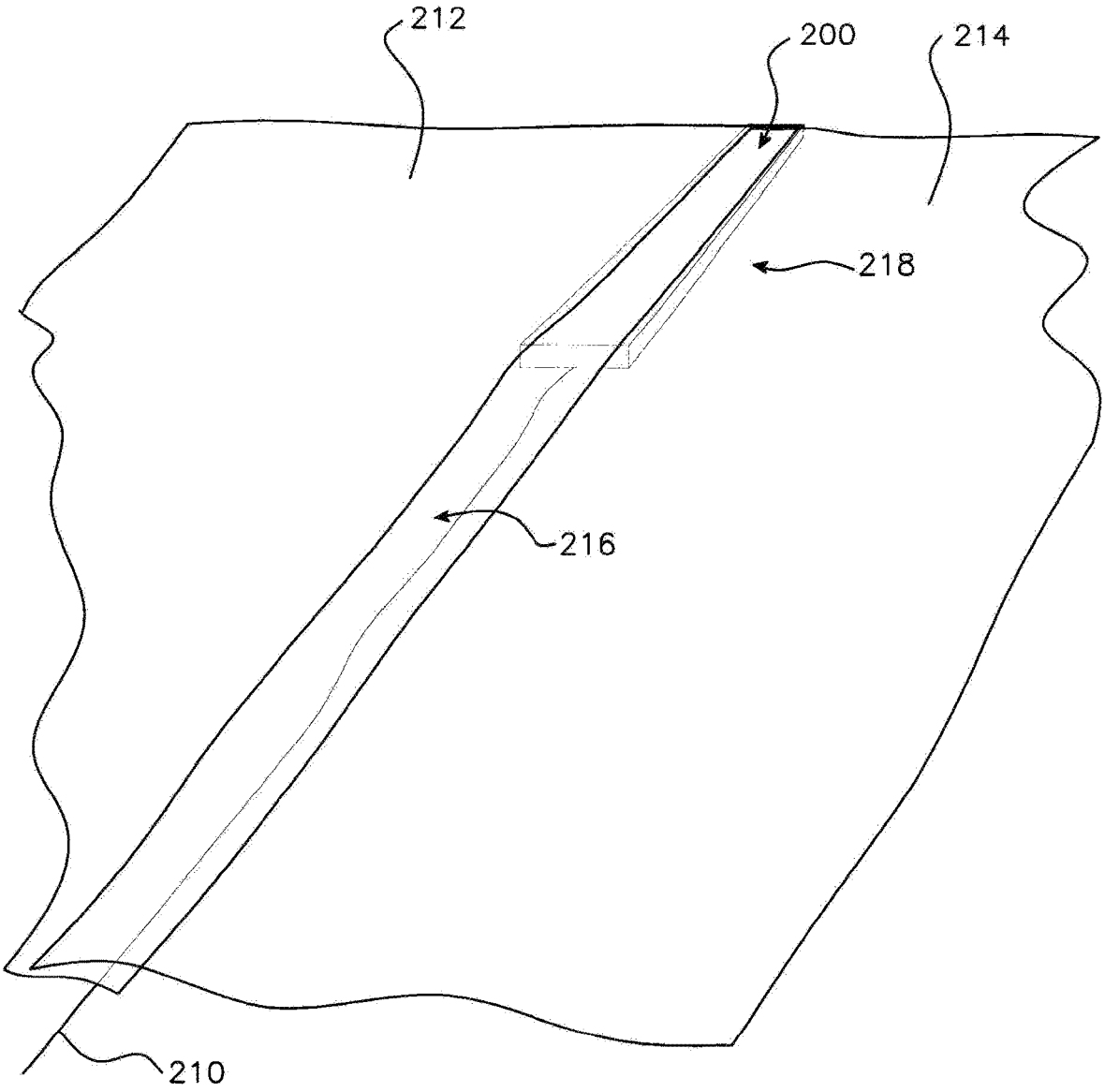

As shown in FIG. 5, two adjoining lengths of heat shrinkable material 212 and 214 are then laid out side by side with an overlap 216 of approximately 150 mm over the supporting element 200 and the rope or cable 210, and so that the supporting element 200 underlies a first portion 218 of the overlap. Adhesive tape is applied to the outer edge of the overlap, at least for the first portion 218 of the overlap 216, if required.

Figure 6:
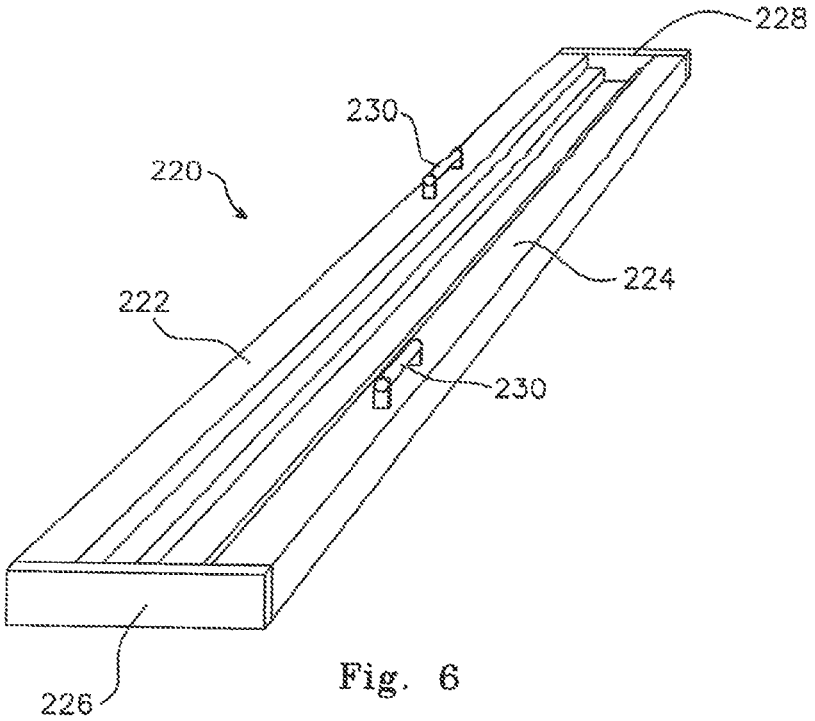
FIG. 6 is a perspective view of a guide rail assembly suitable for use with the embodiments of the invention.

As shown in FIG. 6, a guide rail assembly 220 is then laid over and centrally along the first portion 218 of the overlap to rest on the supporting element 200 with the overlapping portions of the two lengths of material 212 and 214 secured between the rail assembly 220 and the supporting element 200.

Figure 7:
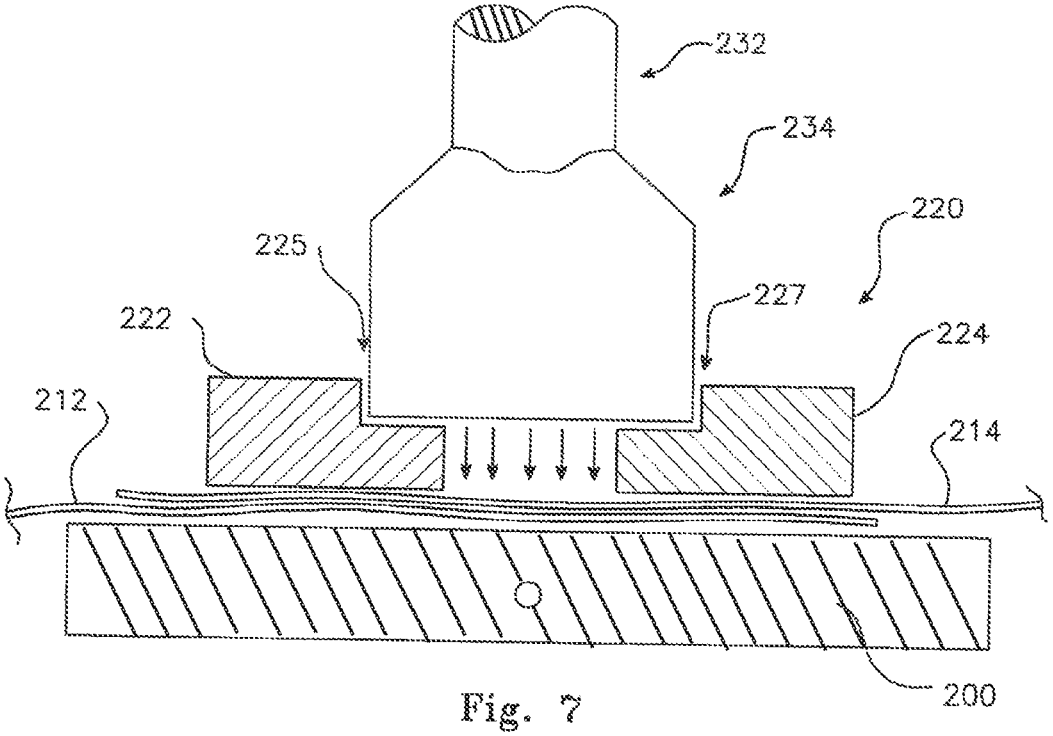
FIG. 7 is a section view of a heat gun operating in conjunction with the guide rail of FIG. 6.

The guide rail assembly 220 comprises two, spaced apart, rigid rail elements 222 and 224, preferably 1 m in length but may be provided in various lengths, for example 600, 1000 or 1200 mm. The rail elements 222 and 224 are interconnected at their outer ends by connection cross members 226 and 228. Preferably, the end profiles of the rail elements 222 and 224 are as shown in FIG. 7 with recessed inward facing edges 225 and 227 and are preferably spaced 20 mm apart. They are formed of metal, steel or preferably aluminium. Finally, the rail assembly 220 is provided with at least one, preferably two grab handles 230 for manipulating the assembly in use.

A heat gun 232 (partly shown in FIG. 7) is provided with a heat directing shroud 234 sized in width to fit between the recessed edges 225 and 227 of the guide rail assembly 220 and a length sized to deliver a quantum of heat to an area of overlapping sheets of material between the rail assembly sufficient to fuse that area together within a predetermined time duration.

The heat gun 232 with its attached shroud 234 is drawn along the guide rail assembly 220 at an even rate, thus fusing that length of overlap 216 covered by the rail assembly. The guide rail assembly 220 is then drawn with the rope or cable 210 into a next position along the sheet overlap and the guide rail assembly 220 repositioned accordingly. Heat is then applied to this next length of the overlap.

Further Embodiments

Figure 8:
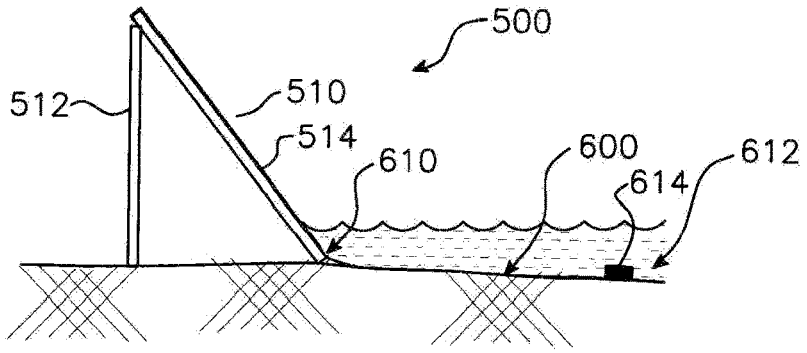
FIG. 8 is a side section view of a flood mitigation barrier in accordance with a further preferred embodiment.
Figure 9:
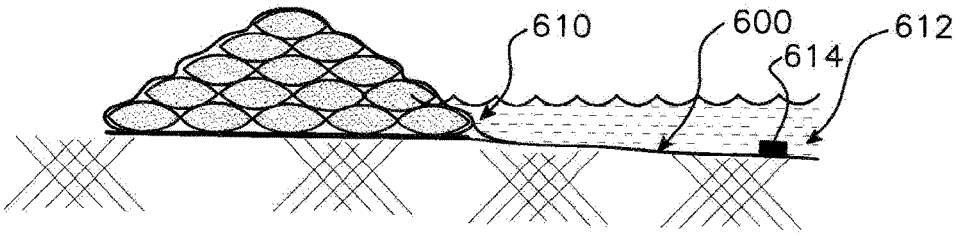
FIG. 9 is a side section view of a flood mitigation barrier in accordance with a further preferred embodiment.

A further example of flood barriers to which a heat shrinkable material according to the invention may be applied is shown in FIG. 8. FIG. 8 illustrated the side section view of a flood mitigation barrier in accordance with a further embodiment in which a barrier 500 is formed of suitable panelling 510 supported by framework 512. Heat shrinkable material is fastened along the top of the panelling and draped along its sloping edge 514 prior to applying heat to shrink the material to the panelling.

Figure 10:
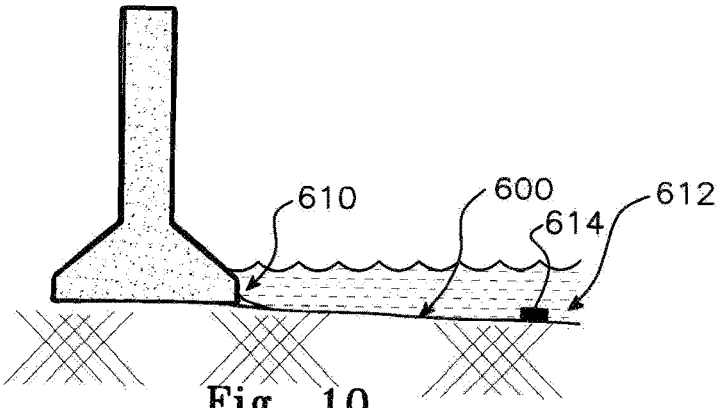
FIG. 10 is a side section view of a flood mitigation barrier in accordance with a further preferred embodiment.
Figure 11:
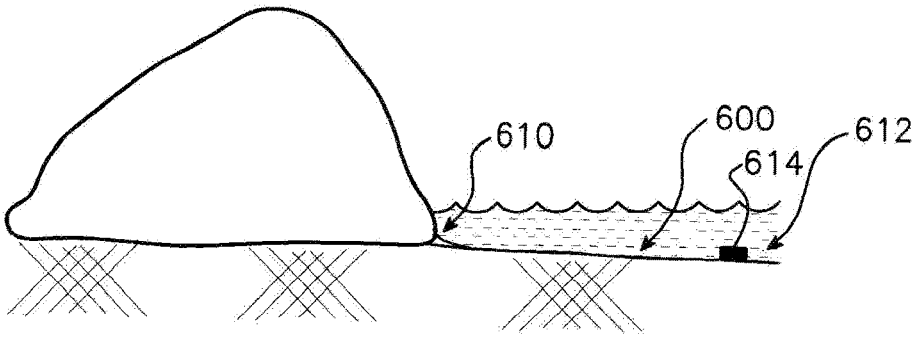
FIG. 11 is a side section view of a flood mitigation barrier in accordance with a further preferred embodiment.

In each of the flood barriers described above and shown in FIGS. 1, 2, 3A, 8 and 9, an impervious "toe" or apron 600 may be provided as shown in FIGS. 8 to 11. In a preferred form this impervious toe feature may be formed of the same or compatible polymer film to that of the heat shrinkable material. The toe or apron 600 provides an apron extending from the flood side of the flood mitigation barrier and anchored to the film wrapped around the barrier. In a preferred form the apron extends at least 2 metres from the flood side. The toe or apron 600 forms an impervious strip along the barrier as an aid to preventing or reducing water penetrating under the barriers. In the alternative or an addition the toe or apron 600, by virtue of its mechanical connection to the film wrapped around the barrier may assist in resisting the overturning moment induced in the barrier structure by the weight of water acting substantially laterally against it in use.

In a particular preferred form the constitution of the film at least for the apron portion is selected so that the weight of water acting upon it causes it to conform to the ground surface upon which it is laid thereby assisting in providing an anchor function to resist the lateral forces imparted on the barrier by the water retained on the flood side of the barrier. In a preferred form the film is selected to be in the range of 50 microns to 300 microns. In a particular preferred form the film is constituted from the same material as the film applied around the barrier. In one preferred form the film utilized for both the apron and the barrier wrap comprises the same contiguous piece of film. In an alternative form the film forming the apron is a separate piece of film from the film forming the barrier wrap.

The proximate edges 610 of the apron are heat welded to the heat shrinkable material enveloping the respective barriers. In a preferred form the distal edges 612 of the apron are weighed down temporarily by weights 614. In a preferred form as flood water rises, it will force the apron material into close conformity with the ground surface.

The process of preparing a flood barrier which includes such an apron feature may be summarised by the following steps;

- Placing a dry cement underlay over the proposed protection area,
- Place the heat shrinkable material out in a "lay flat" position,
- Wrap the material around the flood barrier,
- Weld an overlap of the toe 600 material to the wrap material of the barrier,
- Heat shrink the material of the barrier wrap, though not that of the toe 600.

The invention claimed is:

1. A method of forming a flood mitigation barrier; the method including the steps of:

- preparing an intended path of the flood mitigation barrier with a layer of settable material,
- sequentially positioning sections of sheets of a flexible heat shrinkable polymer material along the intended path such that edges of adjacent sheets overlap with respect to the intended path,
- heat welding overlap portions of said edges to form a continuous strip of the flexible heat shrinkable polymer material along the intended path,
- positioning a line of road barriers end to end centrally along the continuous strip such that the line of road barriers is disposed between two opposing side portions of the continuous strip,
- drawing said two opposing side portions up and over the line of road barriers such that said two opposing side portions wrap the line of road barriers and such that longitudinal edges of the two opposing side portions overlap,
- heat welding said longitudinal edges of the two opposing side portions to one another, and
- applying heat to the flexible heat shrinkable polymer material to conform the material to the line of road barriers, wherein formation of the continuous strip of the flexible heat shrinkable polymer material includes the steps of:

- positioning an elongate supporting element on a ground surface,
- extending a rope or cable attached at an end of the supporting element along an intended position of an overlap of a first two adjoining sections of the flexible heat shrinkable polymer material,
- positioning two adjoining lengths of the flexible heat shrinkable polymer material with a predetermined overlap over the supporting element and the rope or cable,
- positioning a guide rail assembly over a first overlap portion of the two adjoining lengths of the flexible heat shrinkable polymer material and coincident with the supporting element, and
- moving a heat gun provided with a heat directing shroud along the guide rail assembly to fuse the first overlap portion of the two lengths of flexible heat shrinkable polymer material together.

2. The method of claim 1 wherein the line of road barriers comprises an elongate assembly of stacked sandbags.

3. The method of claim 1 wherein the line of road barriers comprises sections of metal frames of triangular cross section placed end to end.

4. The method of claim 1 wherein the method further includes the steps of:

removing the guide rail assembly and the elongate supporting element from the first two adjoining sections of the flexible heat shrinkable polymer material and applying the steps of claim 1 to a next overlap of the continuous strip of the flexible heat shrinkable polymer material.

5. The method of claim 4 wherein the method includes the further steps of providing an apron of impervious extending from a flood facing toe of the flood mitigation barrier to form an impervious strip of material along a flood side of the flood mitigation barrier.

6. The method of claim 5 wherein proximate edges of the strip of impervious material are heat welded to the heat shrinkable material covering the flood mitigation barrier.

7. The method of claim 1 wherein the line of road barriers comprises sections of metal frames placed end to end.

* * * * *